United States Patent [19]

Kvamsdal

[11] 4,104,887

[45] Aug. 8, 1978

[54] PROCEDURE FOR LOADING COOLED, LIQUEFIED GASES, AND TANK FOR STORING AND/OR TRANSPORTATION OF COOLED, LIQUEFIED GASES

[75] Inventor: Rolf Kvamsdal, Moss, Norway

[73] Assignee: Moss Rosenberg Verft A/S, Jeloy, Norway

[21] Appl. No.: 713,621

[22] Filed: Aug. 11, 1976

[30] Foreign Application Priority Data

Jun. 29, 1976 [NO] Norway ..... 762252

[51] Int. Cl.[2] ..... F17C 7/02

[52] U.S. Cl. ..... 62/45; 114/74 A; 220/901

[58] Field of Search ..... 62/54, 55, 45; 114/74 A; 220/9 LG

[56] References Cited

U.S. PATENT DOCUMENTS

| | | | |
|---|---|---|---|
| 3,352,123 | 11/1967 | Ulbricht et al. | 62/55 |
| 3,374,638 | 3/1968 | Basile et al. | 62/55 |
| 3,748,865 | 7/1973 | Laverman et al. | 62/50 |
| 3,828,709 | 8/1974 | Bognaes et al. | 62/55 |

*Primary Examiner*—Ronald C. Capossela

*Attorney, Agent, or Firm*—Harold L. Stults; Pasquale A. Razzano

[57] ABSTRACT

When loading liquefied gas in a non-cooled skirt-supported tank the transitional area between the tank wall and the skirt is cooled down by direct cooling. Cooling arrangements for such cooling are disclosed.

8 Claims, 7 Drawing Figures

Figure 1A:
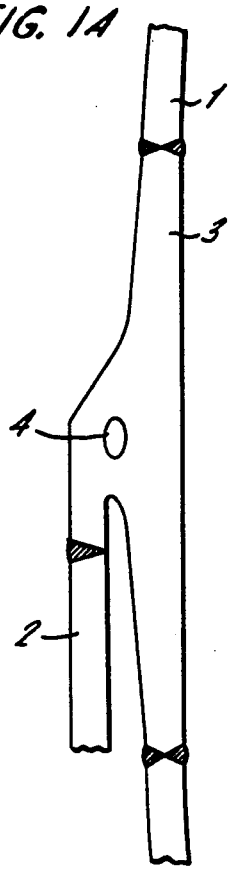

PROCEDURE FOR LOADING COOLED, LIQUEFIED GASES, AND TANK FOR STORING AND/OR TRANSPORTATION OF COOLED, LIQUEFIED GASES

The invention relates to the storing and/or transportation of cooled, liquefied gases and is particularly developed in connection with the transportation of earth gases in cooled, liquid form, especially liquefied natural gas, so-called LNG, and will be described in connection with such gas transportation but the invention can naturally also be used to advantage for the storing and/or transportation of other gases, e.g. the so-called petroleum gases or LPG.

Before, for instance, a tanker can take on board the liquid gas cargo, the tanks have to be cooled down to a temperature close to that of the temperature of the cargo. This cooling-down takes place to-day by spraying in the cooled, liquefied gas, e.g. LNG, through nozzles arranged in the various tanks. The vapourized LNG is sucked out again and returned normally to land, or is used in the propulsion machinery of the ship. The cooling-down process should not take place too quickly, as otherwise too high temperature tensions result in parts of the tank wall. The cooling-down time is between 30 a and 40 hours for aluminium and 15 hours for 9 % nickel steel. After this time the tanker will be ready for loading.

For tanks mounted on a skirt, e.g. the known spherical tanks which are mounted on a skirt which is connected to the spherical tanks in a transitional area where an equatorial ring is arranged which is included as a part of the spherical tank, it has been found that strictly speaking it is only the transitional area or the equatorial profile which needs cooling down in advance. The tank, moreover, can be cooled at the same time as the cargo is taken in and by the cargo itself.

In accordance with this, is provided therefore according to the invention a procedure for loading cooled, liquefied gases in non-cooled tanks which are mounted on a skirt, and the fundamental concept of the invention is that before loading, the transitional area between the tank wall and skirt is cooled down by direct cooling. A practical solution can be to arrange cooling of the equatorial ring alone when it is a question of spherical tanks of the type mentioned previously. Cooling ducts at different levels can also be arranged on the skirt below the equator, because thereby control of the cooling down can be achieved toward the desired temperature distribution.

The particular advantage obtained with the invention is that the considerable cold effect can be reduced which previously known cooling technique required before the loading could be begun, or to be more precise before the level of the cargo in the tank reached the equatorial profile. One additional advantage is that the cooling down will be independent of the atmosphere of the tank. The cooling down period can, moreover, also be abbreviated. This is achieved to an even greater degree by arranging cooling ducts at different levels on the skirt, as mentioned above. At the same time the cooling down process can then be controlled to the desired temperature distribution.

The cooling down time of the equatorial profile and the skirt can hereby be brought down to half the unloading time for the ship's tanks, whereby little or no time is wasted for cooling down from the surrounding temperature to the low temperature the equatorial area must be brought to before the cargo can be permitted to come in contact with the area.

According to the invention, a procedure is therefore provided as stated in claim 1. The invention relates in addition to a tank mounted in a skirt as stated in claim 2. Additional advantageous details with the tank itself are stated in the sub claims connected to claim 2.

Figure 1B:
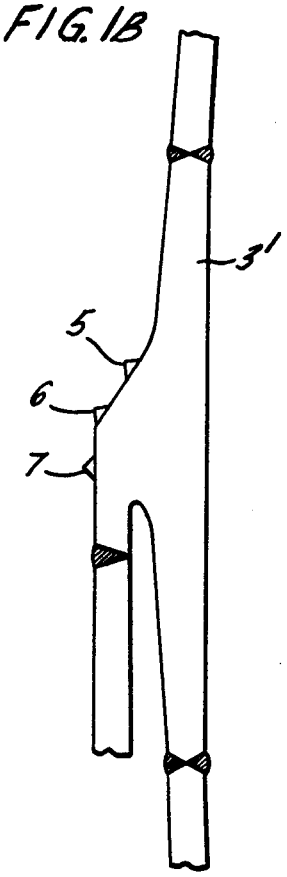
Figure 1C:
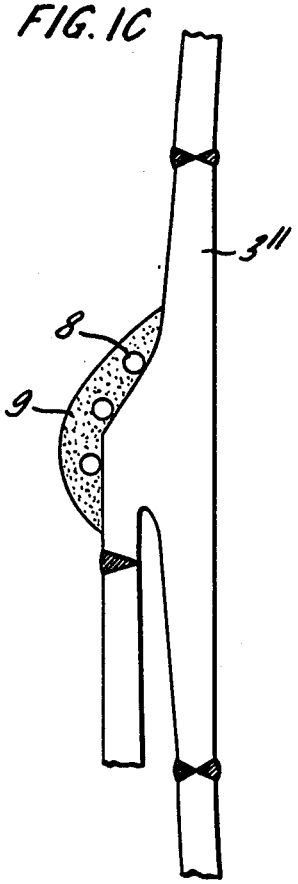
Figure 2:
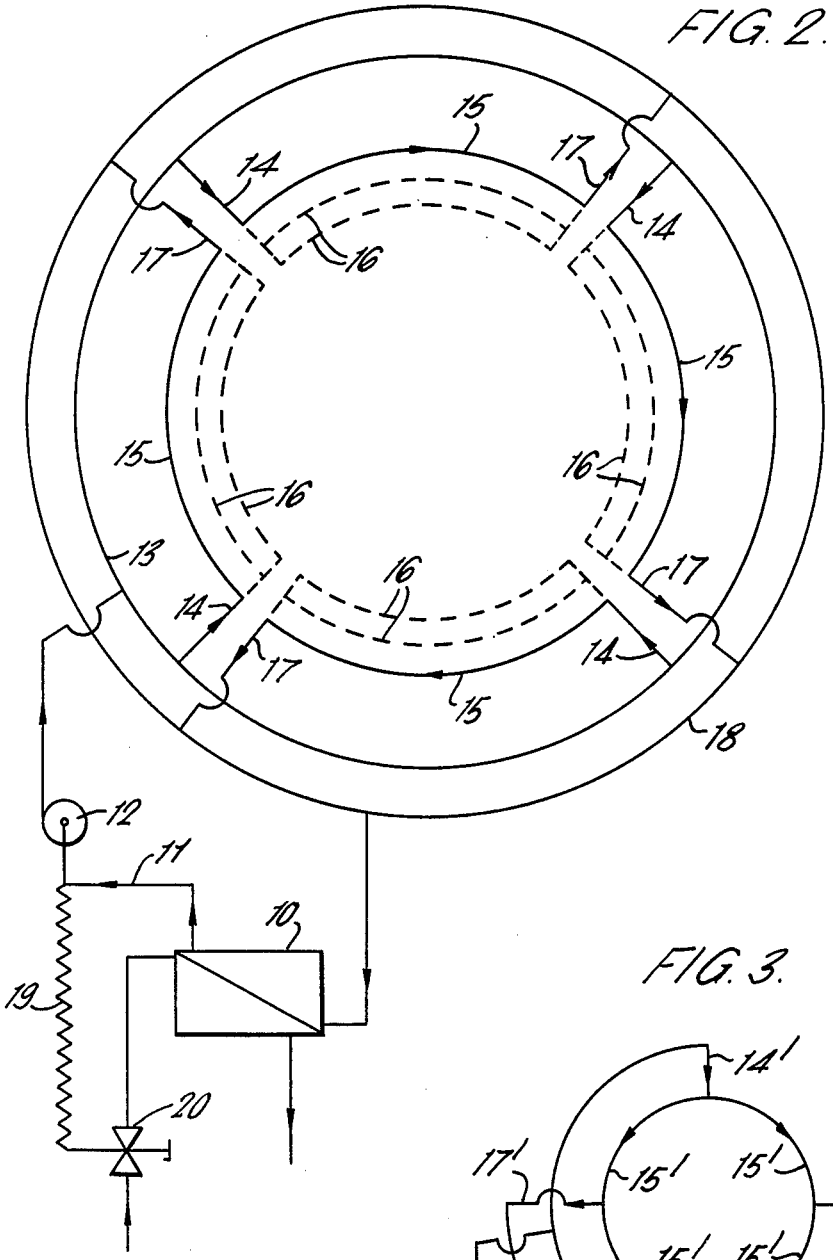
Figure 3:
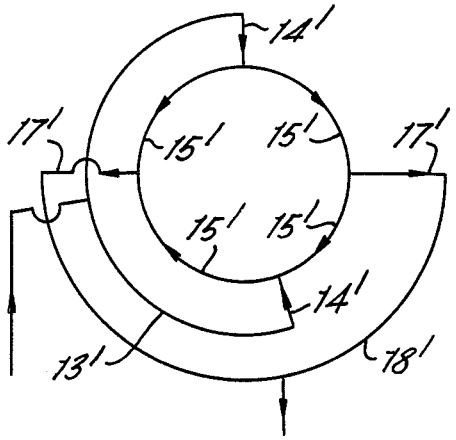
Figures 4, 5:
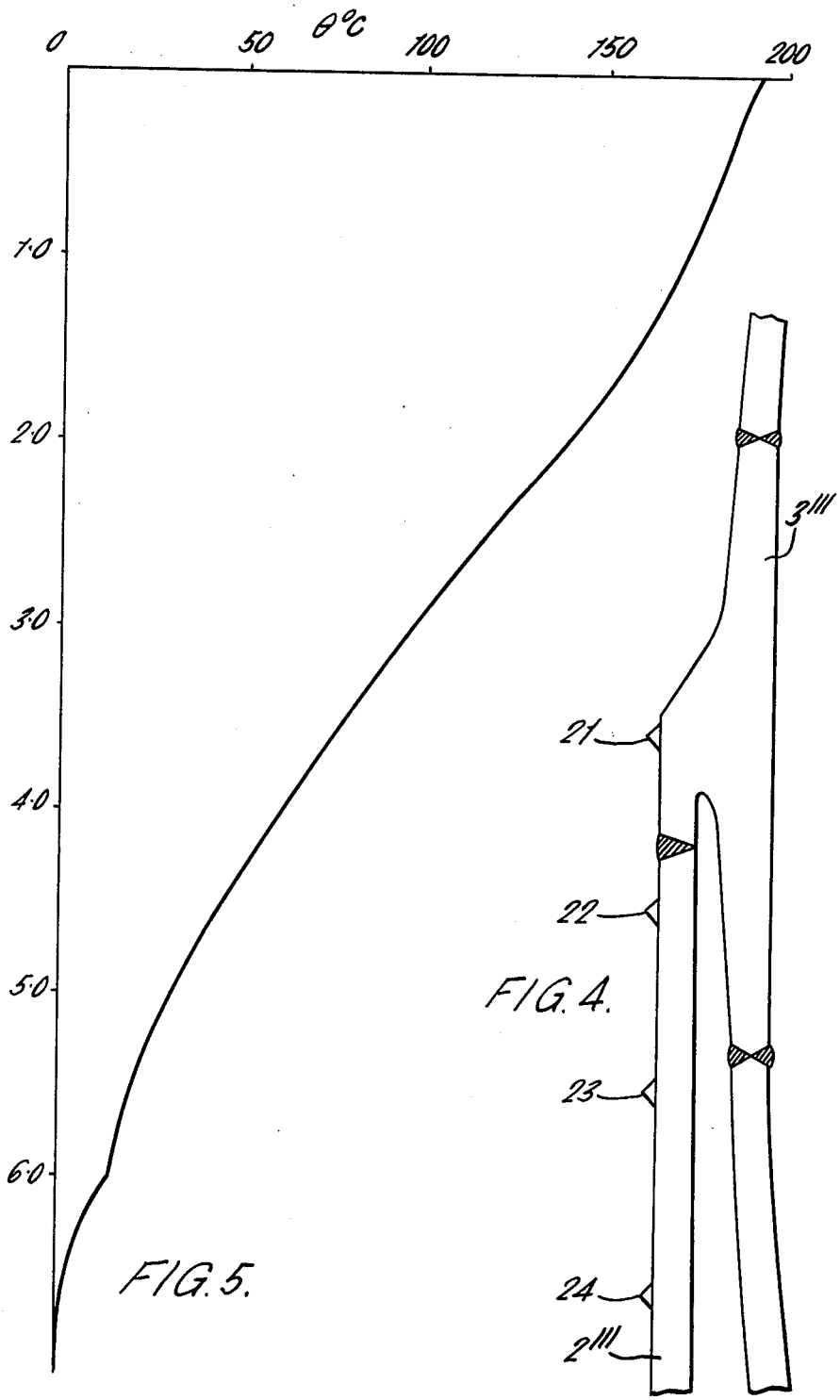

The invention will be explained more in detail with reference to the drawings, where, FIG. 1*a* is a side sectional view of the transitional area between a tank wall and skirt support for spherical tank, including a cooling duct in accordance with one embodiment of the present invention;

FIG. 1*b* is a sectional view, similar to FIG. 1*a*, of another embodiment of the present invention;

FIG. 1*c* is a sectional view, similar to FIG. 1*a*, of yet another embodiment of the present invention;

FIG. 2 shows the cooling arrangement very roughly, with supply and discharge of the cooling medium, FIG. 3 shows a modified cooling arrangement, FIG. 4 shows the arrangement of cooling ducts in different levels on the skirt, also for a spherical tank, and FIG. 5 shows a temperature profile with desired temperature distribution in the skirt.

In FIG. 1 FIG. 1A shows a transitional area between a spherical tank 1 and a skirt 2. In the spherical tank 1 an equatorial ring 3 is put in as a part of the spherical tank's wall. In the equatorial ring 3 is arranged a cooling duct 4 for the cooling medium running around the ecuator.

FIG. 1B shows another embodiment for a similar spherical tank construction. On the equatorial ring 3' are welded here firmly on its outside, angle profiles 5, 6 and 7 which form the cooling medium ducts.

FIG. 1C shows another possible construction where pipe coils 8 are laid in heat conducting mastic 9 on the outside of the equatorial ring 3''.

FIG. 2 shows very roughly how the supply and discharge of the cooling medium can be constructed. The heat exchangers of the apparatus are marked with 10. From the cooling medium side of the heat exchangers a pipe-line 11 goes to a pump 12 which presses the cooling medium in to a distributing pipe 13. The distributing pipe 13 is connected to the sectional cooling ducts 15 by means of service pipes 14. Possible extra parallel cooling ducts are marked 16, and 17 is the discharge pipe to a collecting pipe 18 which leads back to the heat exchanger 10. In FIG. 2 the reference number 19 designates in addition a probe, while a regulating valve is marked 20.

In a construction of this kind, the cooling ducts are sectioned in such a way that the length of the ducts is not so great that the drop in temperature is too great. Another advantage which can be obtained by dividing into sections in an equal number of parts, is that by turning the current in the sections consecutively (alternately) around the ecuator, the number of feed-pipes and the number of discharge pipes can be reduced, as each such pipe then can serve two ducts. At the same time the advantage is obtained that there will not be any temperature gradient between two closely lying feed- and discharge pipes. An arrangement like this is shown in FIG. 3. The same reference numbers are used as in FIG. 2, with the additional of an apostrophe.

FIG. 4 shows a variant where cooling medium ducts 21, 22, 23 and 24 are arranged not only on the ecuatorial ring 3''', but also downward on the skirt 2'''. In this manner the temperature distribution can be controlled, so that the desired temperature profile can be obtained, see FIG. 5. The temperature of the cooling medium can be regulated at every level so that the temperature suits the desired temperature. The arrangement shown in FIG. 2 can be used, with possible simplifications which will be obvious to the expert.

A considerable reduction of the cold effect required for the cooling down process is achieved with the invention. This is gained by the fact that in reality only the area is cooled down where cooling in advance is necessary. As already mentioned, the cooling time also can be reduced, e.g. through the construction as shown in FIG. 4. In that the heat which is led away has a shorter distance to travel, the cooling down time is reduced.

Having described my invention, I claim:

1. The method for loading cooled, liquefied gases in a non-cooled tank which is mounted on a peripheral skirt support structure at least partially surrounding said tank and which tank includes an integral transitional support member forming a portion of the tank wall and being rigidly secured to said skirt support, said method comprising the steps of, directly cooling said transitional support member between the tank and the skirt support structure and thereafter loading liquefied gases in the tank.

2. In a tank structure adapted to contain liquefied gas and being mounted on a skirt support structure comprising an integral peripheral skirt at least partly surrounding said tank and having one end rigidly secured thereto, said tank including an integral support member forming a peripheral portion of the tank and including an extension portion extending beyond the tank and being rigidly connected to said one end of the skirt to define a transitional area between the peripheral skirt and the tank, the improvement comprising means for cooling said transitional area between the tank wall and said skirt before the tank is loaded with liquefied gases.

3. In a tank structure according to claim 2, wherein said cooling means comprises cooling medium ducts placed on the outside of the transitional area.

4. In a tank structure according to claim 2, wherein said cooling means comprises selected cooling medium ducts located within the material in the transitional area.

5. In a tank structure according to claim 2, wherein said cooling means includes cooling medium ducts located at predetermined levels along the skirt.

6. In a tank structure according to claim 2, wherein said cooling means includes a plurality of cooling ducts associated with predetermined sections of at least said transitional area.

7. In a tank structure according to claim 2 wherein said cooling means includes pairs of sectional cooling ducts having common feed-pipes and drain-pipes.

8. In a marine vessel for transporting or storing liquefied gas, a spherical tank adapted to contain liquefied gas, an annular skirt tank supporting structure at least partially surrounding said tank and having one end rigidly secured thereto and a diameter slightly larger than the diameter of the tank; said tank including an annular transitional section for connecting the tank to said one end of the skirt, said transitional section forming an integral portion of the tank having an inner surface forming a portion of the inner surface of the tank and an extension portion extending beyond the tank and being rigidly connected to said one end of the skirt; and means for cooling the transitional section between the skirt and the remainder of the tank wall before the tank is loaded with liquefied gas.

* * * * *